United States Patent [19]

Baker

[11] Patent Number: 4,817,528

[45] Date of Patent: Apr. 4, 1989

[54] METHOD AND APPARATUS FOR MAKING PERSONALIZED PLAYING CARDS

[76] Inventor: Jacqueline M. Baker, 7 S. 18th Ave., Yakima, Wash. 98902

[21] Appl. No.: 888,741

[22] Filed: Jul. 21, 1986

[51] Int. Cl.[4] ..... B41N 1/00

[52] U.S. Cl. ..... 101/395; 101/368; 101/372; 101/426; 273/292

[58] Field of Search ..... 101/91, 426, 368, 372, 101/395; 273/292, 293

[56] References Cited

U.S. PATENT DOCUMENTS

| | | | |
|---|---|---|---|
| 35,861 | 7/1862 | Wilson | 229/71 |
| 548,216 | 10/1895 | Murray | 273/293 X |
| 548,579 | 10/1895 | Murray | 273/293 X |
| 817,663 | 4/1906 | Pifer | 430/496 |
| 874,644 | 12/1907 | Torrani | 354/282 |
| 1,109,543 | 9/1914 | Phipps | 273/296 |
| 1,232,796 | 7/1917 | Hardenbrook | 430/496 |
| 1,455,724 | 5/1923 | Hantsch | 430/347 |
| 1,536,345 | 5/1925 | Jones et al. | 378/169 |
| 2,369,031 | 2/1945 | Engle | 446/387 |
| 2,592,122 | 8/1952 | De Jesus | 273/293 |
| 2,663,418 | 12/1953 | Grunwald | 206/455 |
| 4,244,582 | 1/1981 | Raees et al. | 273/293 |

*Primary Examiner*—Edgar S. Burr
*Assistant Examiner*—Moshe I. Cohen
*Attorney, Agent, or Firm*—Seed and Berry

[57] ABSTRACT

An apparatus and method for producing personalized playing card decks. A plurality of front printing plates having card face printing images thereon are provided. One back plate is provided having a plurality of different card back printing images. The front sides of a plurality of card stock sheets are printed with the front plates. The sheets are reversed and the unprinted back sides are printed with the single back plate. The sheets are collated into one stack. The stack is cut into individual decks.

10 Claims, 4 Drawing Sheets

METHOD AND APPARATUS FOR MAKING PERSONALIZED PLAYING CARDS

DESCRIPTION

TECHNICAL FIELD

The invention relates to a method and apparatus for making playing cards of the type which are assembled into a deck of cards wherein each card in the deck has a different, unique face side and a common, decorative back side.

BACKGROUND OF THE INVENTION

A conventional deck of playing cards, such as a poker deck, contains fifty-two different cards arranged in four suits of Ace through King and two wild cards typically called Jokers. Thus, a typical deck has fifty-four playing cards. Each card in a deck, except for the Jokers, has a unique face side. The back side of each card in the deck, however typically has a common arbitrary design.

Card decks of this type are conventionally produced by offset or lithographic printing processes which utilize printing plates or dies to produce the face and back sides of the cards on sheets of card stock material.

FiG. 1 illustrates a printing plate set 20 including the arrangement of playing card printing images on a front plate or die 20*a* and a rear plate or die 20*b*.

The front plate comprises a matrix array of card face printing images. The array has six columns and nine rows of image which produce fifty-four card face images on a sheet of card stock material. The cards are arranged in fours suits of cards, Ace through King. Two Jokers are in the lower right hand corner of the plate.

The back plate has fifty-four corresponding, identical back images. The back images are shown as geometric, hexagon designs for simplicity. More typically, the card back image is a highly fanciful design.

When using this technique, the face or front side of a sheet of card stock having the same exterior dimensions as the perimeters of the plates shown in FIG. 1 is printed on its front and reverse sides with the front and back plates, respectively. Thus, a sheet of card stock material having all the images of the front plate on the front side and all the images of the back plate on the back side is produced. The sheet is then cut along the divisions between the images to produce individual cards and the cards are assembled into a deck. Each card in the deck has a unique face side and a common decorative back side.

The cost of the printing plates is quite high. Such plates can cost on the order of hundreds of dollars each. However, when this conventional technique is used, the cost of the plates can be amortized over the useful life of the plates. On a per deck produced basis, the cost of the plates is reasonable if a large number of identical deck are printed.

The above printing technique is limited in that the cost of a single printing is quite high because only one deck is produced for each printing. As previously stated, this is not a disadvantage as long as a large number of decks are printed and the cost of the plates is distributed among the decks. However, this means that each deck must have the identical back design shown in FIG. 1. For example, if it were desired to place a specialized image on the back of a deck of cards, such as a photograph of a child or a picture of a valuable possession, then the cost of printing one deck would be equal to the cost of manufacturing a back plate. The cost could only be amortized and reduced to a reasonable cost per deck if a large number of decks are produced.

Unfortunately, it is highly unlikely that a simple retail consumer would want to purchase hundreds of decks having one personalized picture on the back side of each deck. Therefore, the prior art method of printing playing cards has precluded personalization of card decks in this manner.

DISCLOSURE OF THE INVENTION

It is an object of the present invention to provide a method and apparatus for producing high quality playing cards having personalized, decorative back sides at a reasonable cost on a per deck basis.

The invention achieves this object, and other objects and advantage which will become apparent from the description which follows, by utilizing a printing plate set having a plurality of different front plates for producing card faces on the front side of card stock sheets. One corresponding back plate is provided having a plurality of different, decorative card back printing images for producing card backs on the reverse sides of the card stock sheets. The card back printing images on the back plate are positioned to register with the card face images on the front plate. The decorative card back printing image are preferably personalized pictures supplied by different customers. The printed sheets are collated into a single stack and the stack is cut into individual decks.

The front plates may be used indefinitely to print the front sides of card stock sheet material. The back plate is used to print decorative, card back images on the reverse side of the sheets which are personalized according to customer orders. The printing images on the front plates are positioned so that a different card face image appears at corresponding locations on the different front plates. In this way, the printed sheets can be collated into one stack wherein each card location has a complete card deck thereat. The stock is then cut with a cutting die to separate the stacked images into individual decks. Because all of the cards in a deck are cut by the same portion of the cutting die, the size of the cards in each deck is quite uniform. The cost of the back plate can be divided among the number of decks produced having different, decorative card back images.

For example, in one of the preferred embodiments of the invention a set of printing plates is disclosed for producing a deck having fifty two cards of Ace through King in fours suits and two Jokers. There are fifty three front plates, the first fifty two front plates each having a different card face printing image thereon for one of the cards in the deck. The fifty third plate has Joker printing image thereon and is used twice per printing. The card face printing images are reproduced on each plate an equal number of times to produce the same number of decks per printing. A corresponding back plate is provided having a plurality of different, decorative card back printing images which are positioned to correspond to the images on the front plates. One on back plate is provided.

Fifty-two sheets of card stock material are each printed on one side with a different one of the first fifty-two front plates. The fifty-third front plate is provided with printing images of the Joker card and is used to print one side of two additional sheets of card stock material to produce two Jokers for each card deck.

Thus, the front sides of fifty-four sheets of card stock material are printed with card faces. Each sheet has a different card image thereon, reproduced a plurality of times.

The sheets are then all reversed so that the unprinted sides are positioned for printing. These reverse sides are then all printed with the single back plate. The sheets are then collated into a single stack. A complete, collated deck exists at each card location in the deck. The stack is then cut into individual decks by a cutting die. Each card in each of the decks has a unique, face side. Each card in each of the decks, however, has a common personalized back side and the card backs differ from deck to deck.

The front plates can be reused to produce any number of decks desired. The cost of the back plate can be divided among the number of deck produced. If, for example, the plates have images arranged in a 9×6 matrix array, and each card back printing image on the back plate is different, the cost of the back plate can be divided among fifty-four decks. Therefore, it is possible to have fifty-four different customers each desiring a single deck having cards with a common, personalized back side. The cost of the back plate is divisible among fifty-four different customers.

BEST MODE FOR CARRYING OUT THE INVENTION

Figure 2:
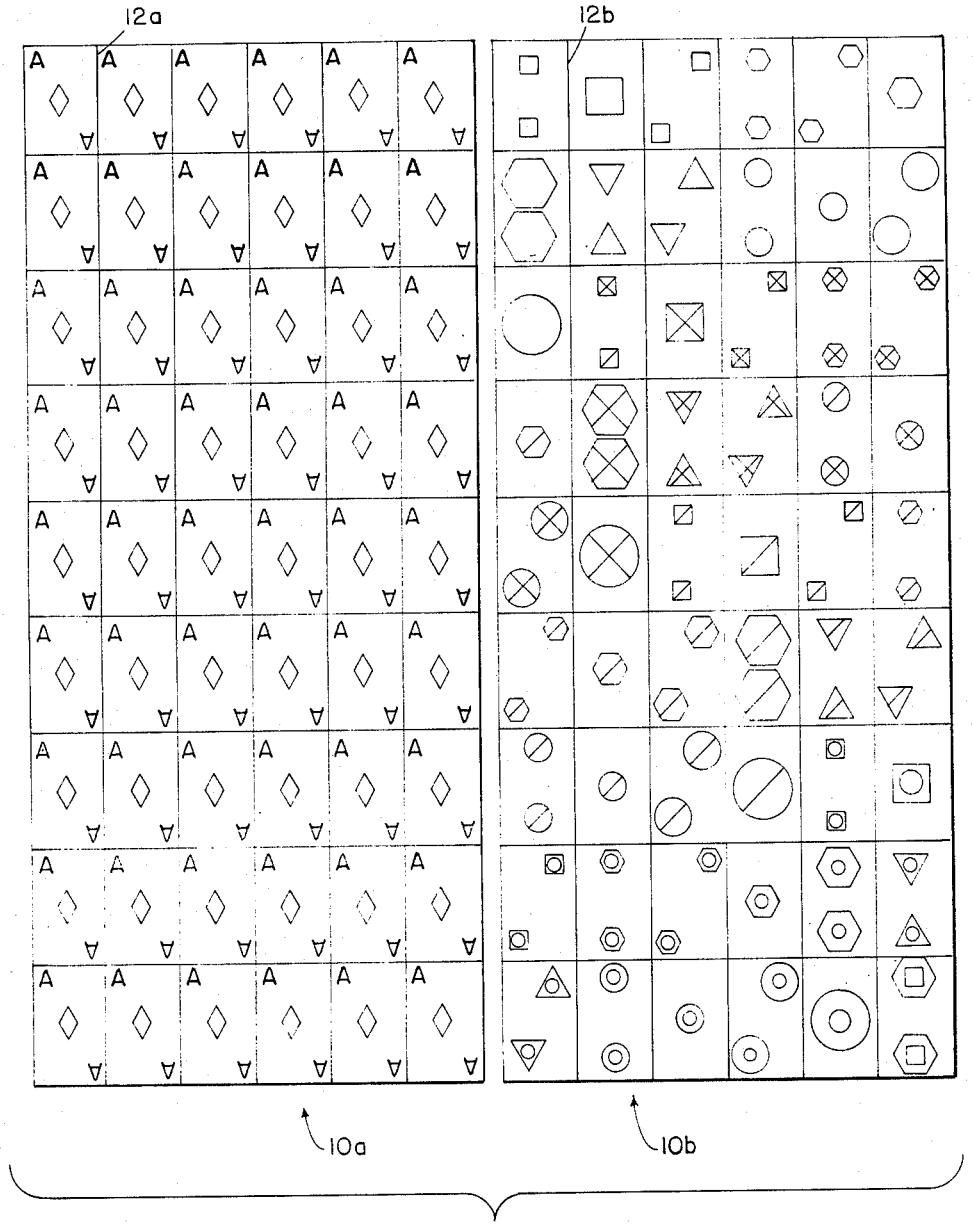
FIG. 2 is a schematic representation of a exemplary front printing plate or die and a rear printing plate or die of the present invention.

FIG. 2 illustrates an embodiment of a partial printing plate set, generally indicated at reference numeral 10, in accordance with the present invention. One front plate 10*a* of a plurality of front plates is shown in the left-hand side of the figure. A back plate 10*b* is shown in the right-hand side of the figure. These figures are schematic in nature and depict the arrangement and location of printing images, such as printing images 12*a* and 12*b* which are used in a photolithographic, offset or other printing process to produce images on a sheet of card stock material (not shown). Offset, lithographic and other methods for printing images are well known and are not considered part of the invention. The invention resides in the arrangement of the printing images 12*a* and 12*b* on the printing plates or dies and the steps used in producing card decks having individualized, decorative back sides. In this disclosure, the term "plate" or "die" is to be understood as including any structure or device which may be used to produce printed images on card stock material.

In order to more clearly describe the embodiment of the invention shown in FIG. 2, the plates 10*a* and 10*b* will be described for use in printing a plurality of playing card decks having fifty-two different cards of Ace through King in four suits and two additional Joker cards.

As shown in FIG. 2, front plate 10A has fifty-four printing images 12*a* arranged in six columns and nine rows. The front printing image 12*a* is the unique face side Ace of Diamonds in the deck. This image is repeated at each location indicated on the front plate. Fifty-one other plates having the remaining unique card faces are produced and have their printing images arranged as shown for front plate 10*a*. The fifty-third plate is produced with printing images of the Joker card thereon in the same locations as shown for front plate 10*a* having the Ace of Diamonds. These plates are used to print the front sides of fifty-four sheets of card stock material.

Each one of the first fifty-two sheets of card stock material is printed with a different one of the fifty-two front plates. The fifty-third and fifty-fourth sheet are printed on their front sides with the front plate having the Joker printing images. Thus, fifty-four sheets of card stock material are produced. On each sheet there are fifty-four identical images of a single card face.

The sheets are then reversed and printed in a conventional manner with the back plate 10*b*. The back plate 10*b* has a plurality of different printing images 12*b*. The images are represented by different geometric patterns, but are preferably individualized pictures, such as children, pets or other images which customers may wish to have imprinted on the card backs of playing cards. Each one of the images 12*b* is different. However, if a customer requests two decks or more decks with the same back image, then the desired back image can be duplicated.

After the reverse sides of the fifty-four printed stock sheets have been printed with the back plate 10*b*,there are fifty-four decks on the sheet having identical card face sides and different decorative back sides. The sheets are then collted into a single stack. A complete, collated deck exists at each card location in the stack. The stack is then cut by a conventional cutting die into individual decks. There are fifty-four decks each having a different, decorative card back image thereon. However, within each deck the card back images are identical and are the personalized images desired by the customer. Because the cards of each deck are cut by the same cutting die, the uniformity of card size within each deck is quite good.

The method for printing the card sheet material disclosed is a highly cost-effective method for producing individualized playing card decks. In the embodiment of FIG. 2, assume that each different, decorative card back printing image 12*b* represents an order from a different customer. In this case, the cost of the back plate 10*b* can be divided among fifty-four different customers. The front plates 10*a* can be used over and over again to produce card face images on the front side of card stock material. Only the back plate 10*b* need be replaced to produce cards having different decorative back sides. Further savings are achieved because each deck is collated before the stack is cut. In the prior art, the cards are cut first and then collated into decks.

Figure 1:
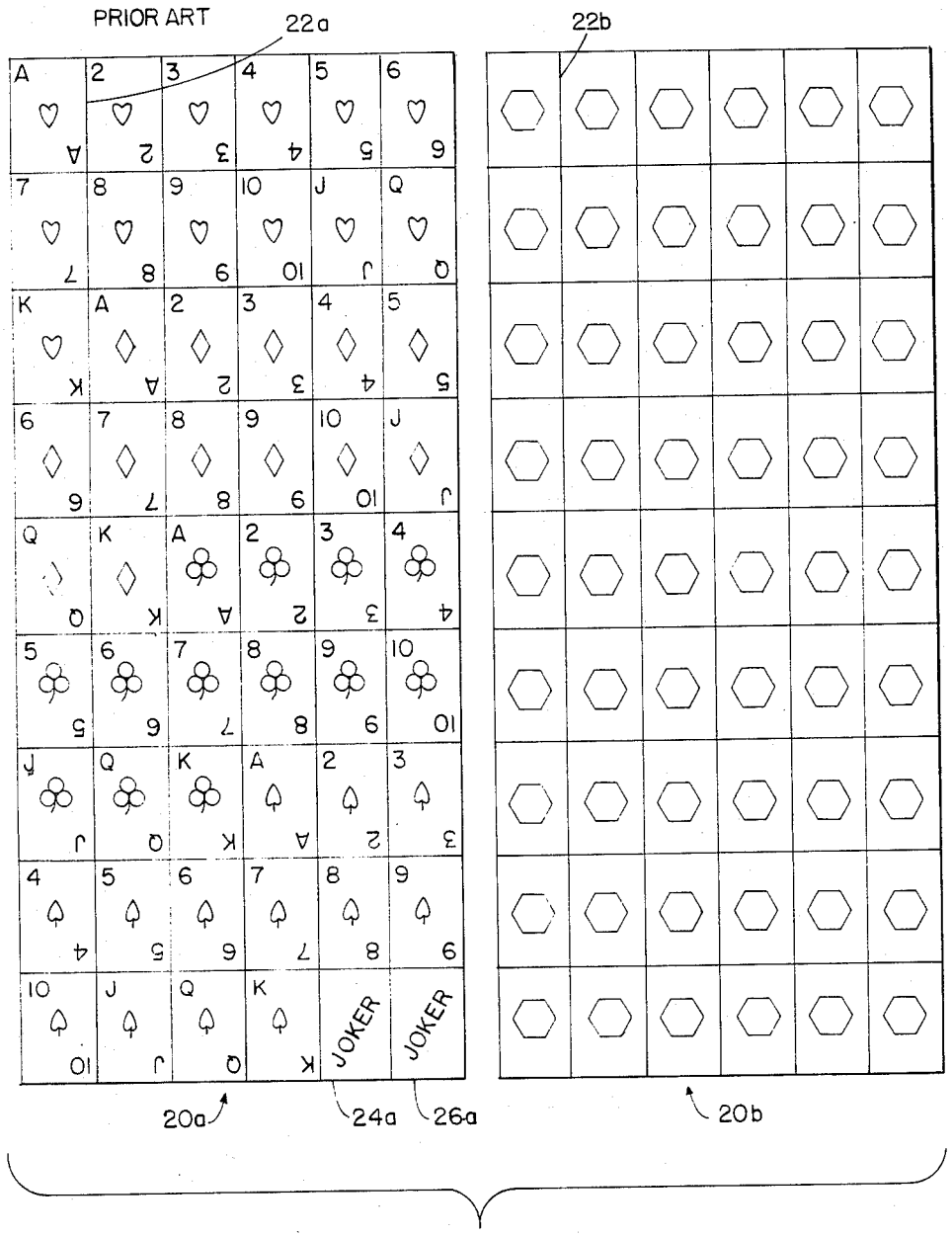
FIG. 1 is a schematic representation of a front and rear printing plate or die of the prior art for producing playing cards.

The prior art method of producing card decks is cost-prohibitive if adapted to producing card decks having individualized card backs. The prior art front plate 20*a* and back plate 20*b* are shown in the left and right-hand sides of FiG. 1, respectively. Front plate 20*a* has fifty-two different front printing image 22*a* arranged in four suits of Ace through King. The last two printing images 24*a* and 26*a* are the Joker printing images. A rear plate 20*b* has fifty-four identical back printing images 22b arranged in rows and columns to correspond to the position of the front printing images 22a on the front printing plate 20a. In this prior art method, a single sheet of card stock material is printed with the front printing plate 20a. The sheet is then reversed to expose the unprinted, reverse side of the sheet and is printed with the back printing plate 20b. The sheet is then cut into individual cards and the cards assembled into a deck. Thus, with each printing only one card deck is produced, and each card in the deck has the identical, decorative card back shown on back plate 20b.

If the images on the prior art back plate 20b represent a single customer, then the cost of printing a deck of cards for that customer is equal to the cost of back plate 20b. Although the front plate 20a may be used over again to produce other decks, a new back plate 20b must be produced for each new customer. Also, an expensive, high quality cutting die is required to produce a card deck having cards of uniform size.

Because the cost of these printing plates can be hundreds of dollars, it is not cost-effective to use the prior art method to produce a single, personalized card deck. When using the prior art method, the only way to reduce the cost of a deck is to produce a large number of decks having the same back images. From a commercial point of view, it is unlikely that any single customer is willing to purchase a sufficient number of decks having the same back image so as to reduce the cost per deck to a reasonable amount.

The method of the present invention illustrated in FIG. 2 has a cost per deck of only 1/54 that of the prior art method. Thus, the cost of producing each deck is reduced to a commercially viable amount.

Figures 3, 4:
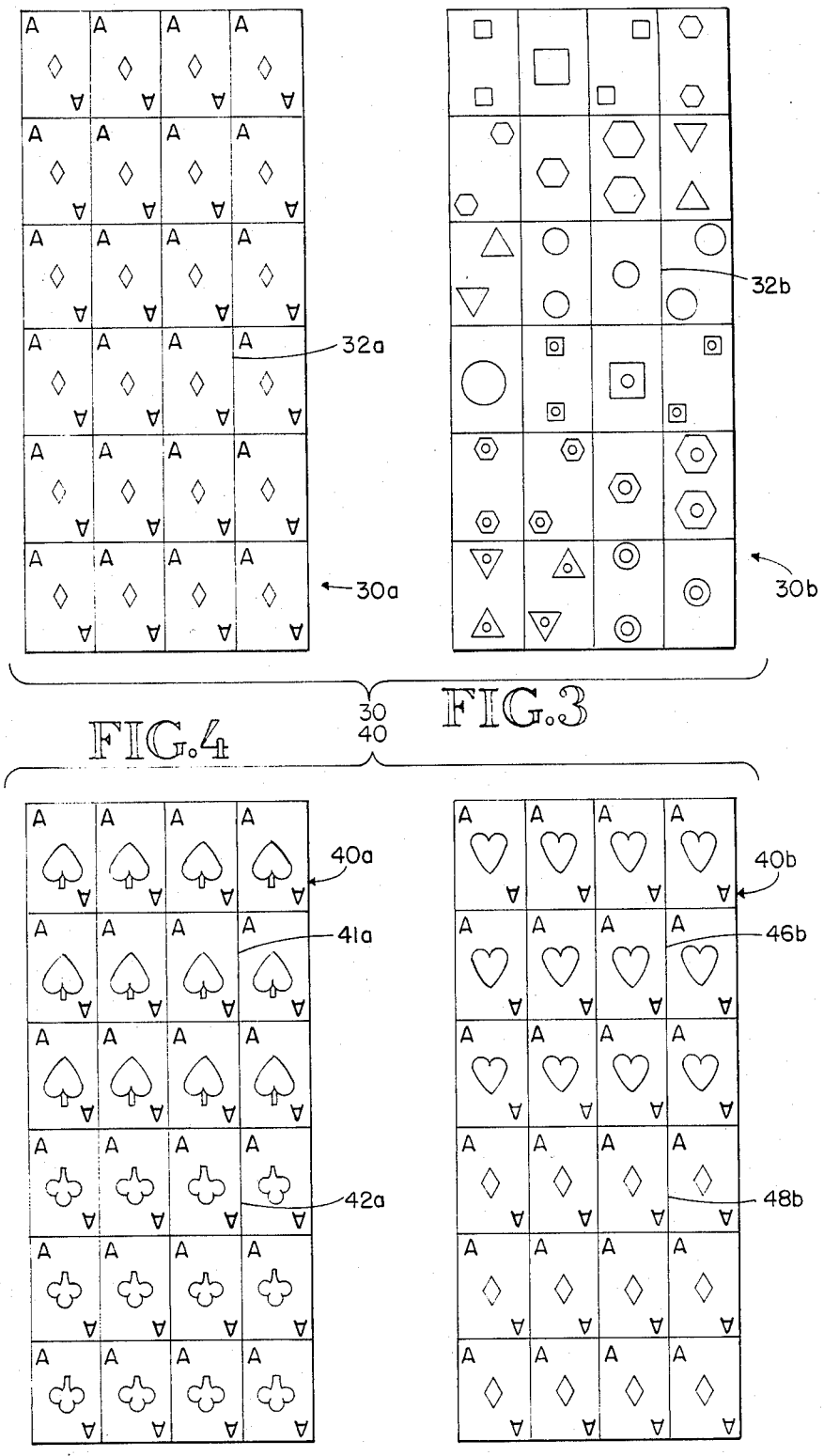
FiG. 3 is an alternative embodiment of the invention shown in FIG. 2.
FiG. 4 is an alternative embodiment of the invention shown in FIG. 3.

FIG. 3 illustrates an alternate embodiment 30 of the invention shown in FIG. 2. In this embodiment, a single front plate 30a is shown as having a plurality of front printing images 32a. The front plate 30a is smaller than the front plate 10a in FIG. 2. The same number of front plates are necessary to produce complete decks as is necessary in FIG. 2.

A back plate 30b is shown on the right-hand side of the figure. The back plate has a plurality of different card back printing images 32b. The images are shown in geometric form for ease of understanding, but are preferably personalized images which a customer desires to have printed on the back of his or her personalized deck. As in FIG. 2, the images are positioned to correspond to the positions of the card front printing images 32a on the front plate 30a. In this embodiment, the images are arranged in a matrix having four columns and six rows. Thus, only twenty four different, decorative card back printing images are needed to begin production. The same printing procedure is followed as is described above for FIG. 2. In this case, however, only twenty four different decks (instead of fifty-four) will be produced and the cost of back plate 30b must be divided among twenty four different customers. Thus, in this embodiment the cost of producing an individual deck is 1/24 that of the prior art. A cost savings over the embodiment of FIG. 2 results because the embodiment shown in FIG. 3 requires a smaller cutting die.

FiG. 4 illustrates a third embodiment 40 of the invention. In this embodiment, a total of twenty-seven front plates and one back plate are required to produce a poker deck having fifty-four cards. Two exemplary front plates, 40a and 40b of the first twenty-six front plates are illustrated. Each of the exemplary front plates has two different types of card face printing images thereon which divide the first twenty-six front plates in to upper and lower halves. Front plate 40a has in its upper half the first card front printing image 41a, the Ace of Spades. The lower half of front plate 40a has a second card front printing image 42a, the Ace of Clubs. The Ace of Club images 42a are inverted relative to the Ace of Spade images 41a; the significance of this will be discussed below. The front plate 40a represents the first of twelve additional plates which have the remaining card front images One of Spades through King of Spades in the upper half of the plate and the One of Clubs through the King of Clubs in the lower half of the plate.

Front plate 40b represents the fourteenth front plte in the series of plates and has in its upper half the card front printing images 46b, the Ace of Hearts. In its lower half, the front plate 40b has lower printing images 48b of the Ace of Diamonds. The next twelve plates in the series (i.e., plates fifteen to twenty-six) contain the printing images of the One of Hearts through King of Hearts in the upper half of the plates and the One of Diamonds through King of Diamonds in the lower half of the plates. Thus, in the first twenty-six front plates of the set all of the unique cards of a conventional poker deck are represented. A twenty-seventh plate has all Joker printing images thereon and is used to produce the Joker cards.

When using this embodiment, the first twenty-six front plates are used to print two sets of card stock sheets (i.e., fifty-two sheets). The twenty-seventh Joker front plate is then used to print two additional sheets wwith Jokers thereon. The second set of twenty-six sheets (duplicates of the first twenty-six sheets) is then collated into a stack, inverted face side up relative to the first twenty-six sheets and placed under the first twenty-six sheets. Upon reflection, it will be apparent that the resulting one stack of collated sheets has a complete card deck at each card location in the stack except for the Joker images. The remaining two Joker sheets are therefor placed at the bottom of the stack to complete the decks. The resulting stack is then inverted to expose the unprinted reverse sides of the sheets and is printed with the back plate 32b of FIG. 3. The stack of sheets, now printed on both the front and reverse sides can be cut with a cutting die as previously described to produce the individual decks. Although the individual decks in this case are collated, only the decks originally located in the upper half of the sheets will present the suits in the preferred order by starting off with the Spade suit.

It has been previously noted that the Ace of Club printing images 42a are reversed relative to the Ace of Spade images 41a. This arrangement is preferred so that when the second stack of collated sheets printed by the fourteenth through twenty-sixth plates (represented by the leadoff front plate 40b) will have its Ace of Heart card properly oriented with the Ace of Club card. The Joker plate also has the Joker images in the upper half of the plate inverted relative to the Joker printing images in the lower half of the plate to maintain the correct orientation of the cards. While this arrangement is desirable, it is not necessary because once the cards are shuffled, the relative positions of the non-symmetrical face cards will become disordered.

As with the previous embodiments, the third embodiment 40 shown in FIG. 4 is advantageous in that each of the decks is provided with the individualized images shown in back plate 32*b*. Furthermore, the cards in each of the decks is cut by the same portion of the cutting die so that the uniformity of cards within an individual deck is quite good.

Figure 5A:
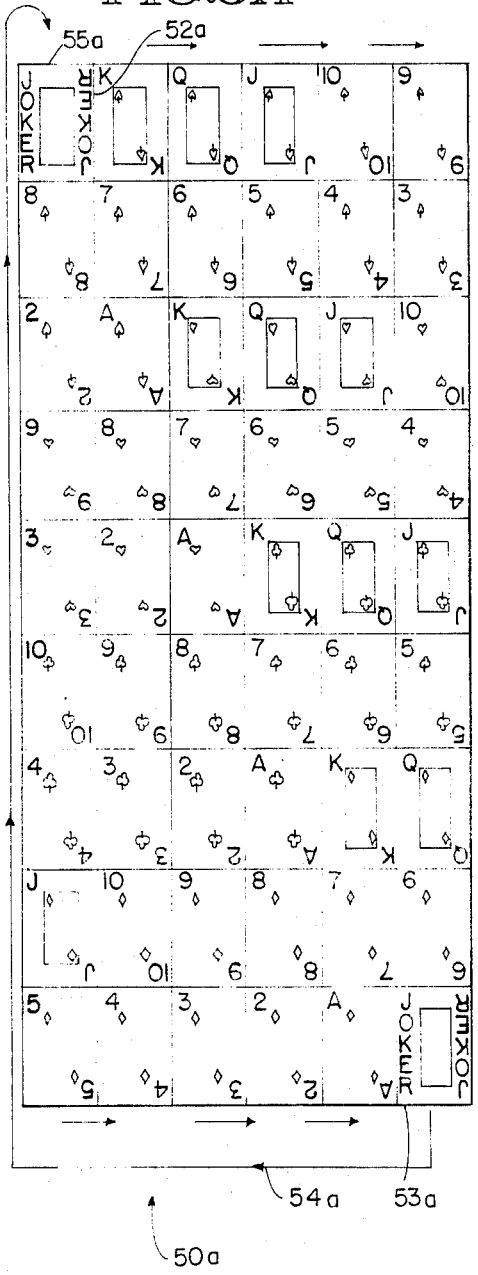
FIG. 5 is yet another alternative embodiment of the invention.
Figure 5B:
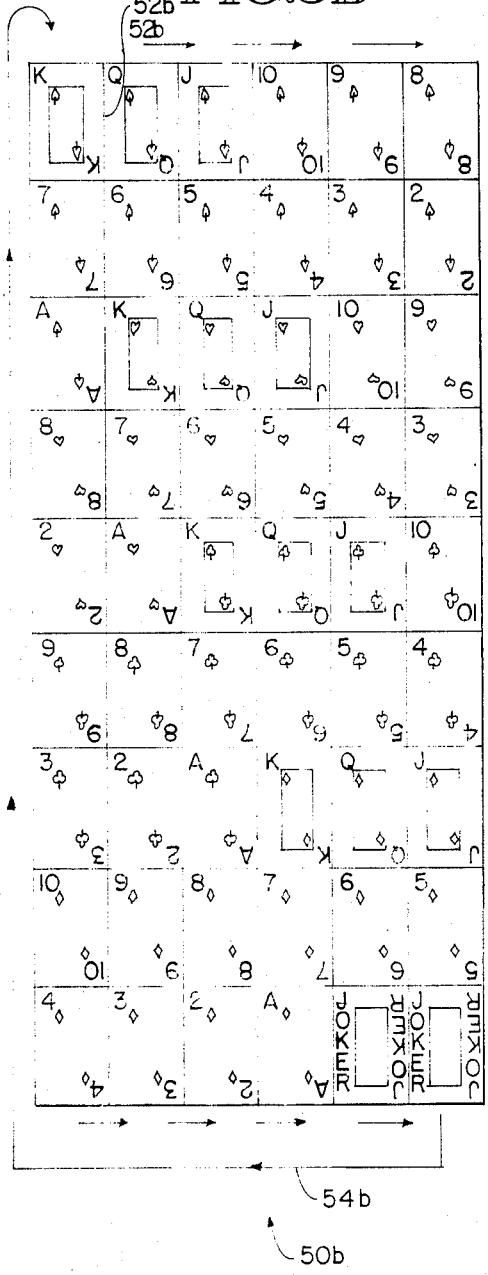

FIG. 5 illustrates another embodiment of the invention which utilizes the fundamental concept of producing a stack of printed sheets wherein each card location in the stack has a complete deck thereat. Two exemplary front plates are generally indicated at reference numerals 50*a* and 50*b*. They represent the first and fifty-fourth front plates in a series of fifty-four front plates for printing the front sides of fifty-four card stock sheets. In this embodiment, the back plate 10*b* of FIG. 2 is used to print the reverse sides of the sheet.

In the first front plate 50*a* of the series, the printing images 52*a* of all of the cards (including the Jokers) of a typical poker deck are laid out in a sequence. As an example only, the cards are laid out in numerical and suit order. With each successive front plate in the series, the card face printing images 52*a* are shifted one place to the right (clockwise). The last image 53*a* in the sequence is shifted (as shown by arrow 54*a*) to the upper left-hand corner position 55*a*, as shown.

The fifty-fourth front plate 50*b* illustrates the position of the printing images after fifty-three such shifts. Note that by shifting the printing images 52*b* one additional place would result in the position shown for the first front plate 50*a*.

In this embodiment, fifty-four sheets of card stock material are printed on their front sides with the fifty-four front plates. These printed sheets are then collated into one stack and inverted to reveal their reverse sides which are printed with back plate 10*b* of FIG. 2. As with the previous embodiments, a complete card deck exists at each card location in the stack. Furthermore, each individual deck has the card back image 12*b* which corresponds to its position in the stack. The stack is then cut with a conventional cutting die to separate the stack into separate decks.

This embodiment is less preferred than the other embodiments for producing conventional poker or pinochle decks because in most of the decks the leadoff card is not the preferred Ace of Spades. However, the cards in each deck are sequentially ordered and once the preferred leadoff card in a deck is located, the remaining cards can easily be transposed to preserve their preferred ordering.

In all of the above embodiments, the basic concept of printing card stock sheets with a plurality of front plates, reversing the sheets and printing the reverse sides with one back plate having a plurality of difference, personalized images is used. This method results in a plurality of printed sheets which are assembled into one stack which has a complete card deck at each card location in the stack. By utilizing this process, high quality individualized card decks can be produced at a reasonable cost. Although a conventional poker deck has been used to describe the preferred embodiment, the apparatus and method disclosed can be used to produce personalized card decks of any type.

In view of the above, it will be appreciated that other variations and embodiments of the invention are contemplated. Therefore, the scope of the invention is not to be limited by the above description, but is to be determined by the claims which follow.

I claim:

1. A set of printing plates for printing personalized playing cards on sheets of card stock material, wherein the cards are of the type which are assembled in a plurality of decks having a specific, total number of cards and wherein each card in a deck has a unique, face side and a common decorative back side, comprising:

fifty-three different front plates, each plate having a plurality of card face printing images for producing card faces on the front side of the card stock sheet, wherein different card face printing images are positioned to register with one another on the different front plates; and one back plate having a plurality of different, decorative card back printing images for producing card backs on the reverse side of the card stock sheets, wherein the card back printing images are positioned to produce card backs which register with the card face on the front side of the card stock sheets so that the printed sheets can be collated in one stack wherein each card location in the stack has a complete card deck thereat.

2. The printing plate of claim 1 including a fifty fourth front plate and wherein the front plates form a series having each of the card face printing images on a front plate corresponding to a different card in the deck and wherein each card front printing image on a front plate is displaced one position from the position of the same image on the previous and subsequent front plate in the series.

3. The printing plate set of claim 2 wherein each front plate has fifty-four card face printing images in four suits of Ace through King and two Jokers, whereby the total number of front plates in the set is fifty-four.

4. A method for producing playing card decks from sheets of card stock material wherein each card in a deck has a unique face side and a decorative back side which is common to all the cards in a deck, comprising the following steps:

arranging a plurality of different card face printing images on a plurality of different front plates so that a different card face printing image is positioned to register with a card face printing image at the same location on the different front plates;

arranging a plurality of different, decorative card back printing images on one back plate corresponding to the positions of the card face printing images arranged on the front plates so that a different card back printing image appears at different locations on the back plate;

printing the front sides of different sheets of card stock material with one of each of the front plates; and reversing the printed sheets and printing the blank, reverse sides of each sheet with the back plate.

5. The method of claim 4, including the following steps:

collating the sheets into one stack whereby the stack has a complete deck at each card location; and cutting the stacked, printed images apart from one another to form individual card decks.

6. The method of claim 4, wherein the number of different card face printing images on each front plate is less than the total number of unique card faces in a deck, wherein all of the card face printing images on a front plate are identical and wherein the number of different front plates used is equal to the total number of unique card faces in a deck, whereby the number of decks produced on the sheets is equal to the number of card face printing images on a front plate.

7. The method of claim 6 wherein each decorative card back printing image on the back plate is unique, whereby each deck in the collated stack has a different, decorative back side.

8. The method of claim 7, adapted for printing card decks of the type having fifty-four cards including four suits of cards Ace through King and two Jokers, wherein the number of different front plates is fifty-three, the first fifty-two plates each having a different one of the cards in the suits as the card face printing images and wherein the fifty-third plate has the Joker as the card face printing image thereon so that the fifty-third plate can be used twice to produce two Joker cards for each deck.

9. The method of claim 4 wherein each front plate has only two different card face printing images positioned thereon to divide the front plates into halves and wherein the number of front plates in the set for printing the unique cards is equal to one-half of the number of unique cards in a deck so that each front plate can be used to print the front sides of two card stock sheets and produce two identical groups of sheets whereby one group can be oriented relative to the other group to result in the collated stack.

10. The method of claim 4 wherein the total number of front plates is equal to the total number of cards in a deck and the front plates form a series wherein each of the card face printing images on a front plate corresponds to a different card in the deck and wherein each card front printing image on a front plate is displaced one position from the position of the same image on the previous and subsequent front plate in the series.

* * * * *